US005102052A

United States Patent [19]

Demarest et al.

[11] Patent Number: 5,102,052

[45] Date of Patent: Apr. 7, 1992

[54] FLUID SPRAY DEVICE

[75] Inventors: Scott W. Demarest, Caledonia; James E. Buhler, Waterford; Allen D. Miller, Mt. Pleasant, all of Wis.

[73] Assignee: S. C. Johnson & Son, Inc., Racine, Wis.

[21] Appl. No.: 599,179

[22] Filed: Oct. 17, 1990

[51] Int. Cl.[5] ..... B05B 11/06

[52] U.S. Cl. ..... 239/355; 239/340; 239/361; 239/525; 222/631; 417/526; 417/527; 417/528; 417/552

[58] Field of Search ..... 239/310, 337, 346, 349, 239/355, 359, 361; 222/631; 417/524, 525, 526, 527, 528, 544, 552

[56] References Cited

U.S. PATENT DOCUMENTS

| | | | |
|---|---|---|---|
| 182,710 | 9/1876 | Riddell | 417/524 |
| 243,163 | 6/1881 | Schlauch . | |
| 572,783 | 12/1896 | Williams | 417/524 |
| 572,907 | 12/1896 | Norton . | |
| 587,638 | 8/1897 | Bills | 417/524 |
| 658,325 | 9/1900 | Stukes et al. | 417/524 |
| 846,718 | 3/1907 | Barber . | |
| 1,218,685 | 3/1917 | Mollenhauer | 239/355 |
| 2,109,589 | 3/1938 | Horwitt et al. . | |
| 2,277,530 | 3/1942 | Rose | 239/355 |
| 2,429,708 | 10/1947 | Cherry | 239/355 |
| 2,444,015 | 6/1948 | Armstrong | 239/355 |
| 2,460,554 | 2/1949 | Vogel | 239/355 |
| 2,639,192 | 5/1953 | Fletcher et al. | 239/361 |
| 2,996,258 | 8/1961 | Commarato | 239/355 |
| 3,485,180 | 12/1969 | Wickenberg et al. . | |
| 3,981,625 | 9/1976 | Wickenberg . | |
| 4,204,645 | 5/1980 | Hopp . | |
| 4,411,387 | 10/1983 | Stern et al. | 239/349 |
| 5,051,073 | 9/1991 | Newbold | 417/526 |

FOREIGN PATENT DOCUMENTS

| | | | |
|---|---|---|---|
| 247231 | 6/1931 | Australia | 239/355 |
| 217693 | 2/1942 | Switzerland | 239/355 |

*Primary Examiner*—Andres Kashnikow
*Assistant Examiner*—Christopher G. Trainor

[57] ABSTRACT

A manually operable spray pump with a double-action pump and a detachable fluid reservoir. A pump cylinder has valves at each end to admit air into one of two pump chambers formed by a piston and means to simultaneously force air from the other chamber down a shaft and out over a fluid discharge port, thereby pulling fluid from the reservoir and spraying it from the device.

12 Claims, 7 Drawing Sheets

FLUID SPRAY DEVICE

TECHNICAL FIELD

This invention relates to the field of devices for spraying fluids and more particularly to a manually-operable double-action air pump which forces a current of air, on both the compression and the extension strokes, over an attached fluid reservoir, thus drawing fluid out of a nozzle extending from the reservoir and propelling a spray of the fluid into the air.

BACKGROUND ART

Manually operable devices for spraying a fluid are well known. Such devices range from the Flit gun pump type to the water pistol or trigger variety.

Many of the earliest such devices employed a single-action air pump to provide the force to dispense a powdered material. U.S. Pat. No. 572,907 to Norton, "Poison Distributer", is of this type.

U.S. Pat. No. 243,163 to Schlauch, "Atomizer", discloses a double action pump which pumps air into a reservoir containing a liquid, thus forcing the liquid out a discharge pipe.

U.S. Pat. No. 2,109,589 to Horwitt et al., "Liquid Pistol", discloses a trigger-activated pump incorporated into a pistol-like sprayer for liquid having a handle portion which is a removable container for the liquid to be sprayed.

U.S. Pat. No. 4,204,645 to Hopp, "General Purpose Compression-Type Sprayer", discloses a single action plunger pump which forces air into a chamber and then into a supply tank holding the material to be sprayed. The material is then forced out a passage to a mixer and ejection orifice.

U.S. Pat. No. 3,485,180 to Wickenberg et al., "Double-Acting Pump for Gas or Liquid", discloses a pump formed by a hollow cylinder and having a piston which has a sealing ring around its periphery and a hollow piston rod, the sealing ring movable between two positions. The cylinder has two closed ends with openable fluid access means at each end. The piston divides the cylinder into two chambers and the piston rod extends through one end of the cylinder. The moveable sealing rod, upon relative motion of the piston and cylinder, opens access means in the piston for fluid recess to one chamber or the other.

SUMMARY DISCLOSURE OF THE INVENTION

The present invention provides an efficient and stream lined manually operated pump for spraying a fluid which will draw up and eject a spray from a fluid reservoir either in the compression (forward) or the extension (back) stroke or relative direction of the action of the pumping chamber and the airshaft and plunger of the piston.

The fluid sprayer has a hollow piston shaft with a piston head at one end, a pumping chamber, a spray head and a fluid reservoir.

At one end, the piston shaft fits into and opens into a channel within the spray head and at its other end has a piston plunger. The pumping chamber is formed by a cylinder that slideably fits over the piston plunger and piston shaft. The piston plunger divides the pumping cylinder into two sections of variable lengths. The pumping chamber has, at each of its ends, a series of air access holes and a flapper valve positioned so as to cover and uncover the holes. The piston head has a channel around its circumference, an air opening extending through the body of the piston head and having openings into the opposite sides of the channel and into the hollow piston shaft, and an o-ring, slightly movable within and larger in diameter than the channel.

Located below the spray head is a fluid reservoir. The fluid reservoir which attaches to the spray head, has a dip tube extending into the reservoir body. The spray head has an actuator assembly, which consists of a closeable valved passageway.

The closeable valved passageway is at its bottom end coextensive with the dip tube and at its upper end opens into a passageway that leads to the fluid outlet orifice of the device.

When the pump is operated, a stream of air is ejected through the hollow piston shaft and into a venturi passage within the spray head. This stream of air then emerges from the air discharge port, creating a zone of lowered pressure. Fluid is drawn up the dip tube from the fluid reservoir, through the valved passageway, and aspirated from the fluid outlet orifice. The fluid is thus atomized and projected from the device in a spray pattern similar in particle size, pattern, and projection to that produced by a pressurized aerosol sprayer.

BEST MODE FOR CARRYING OUT THE INVENTION

Figure 1:
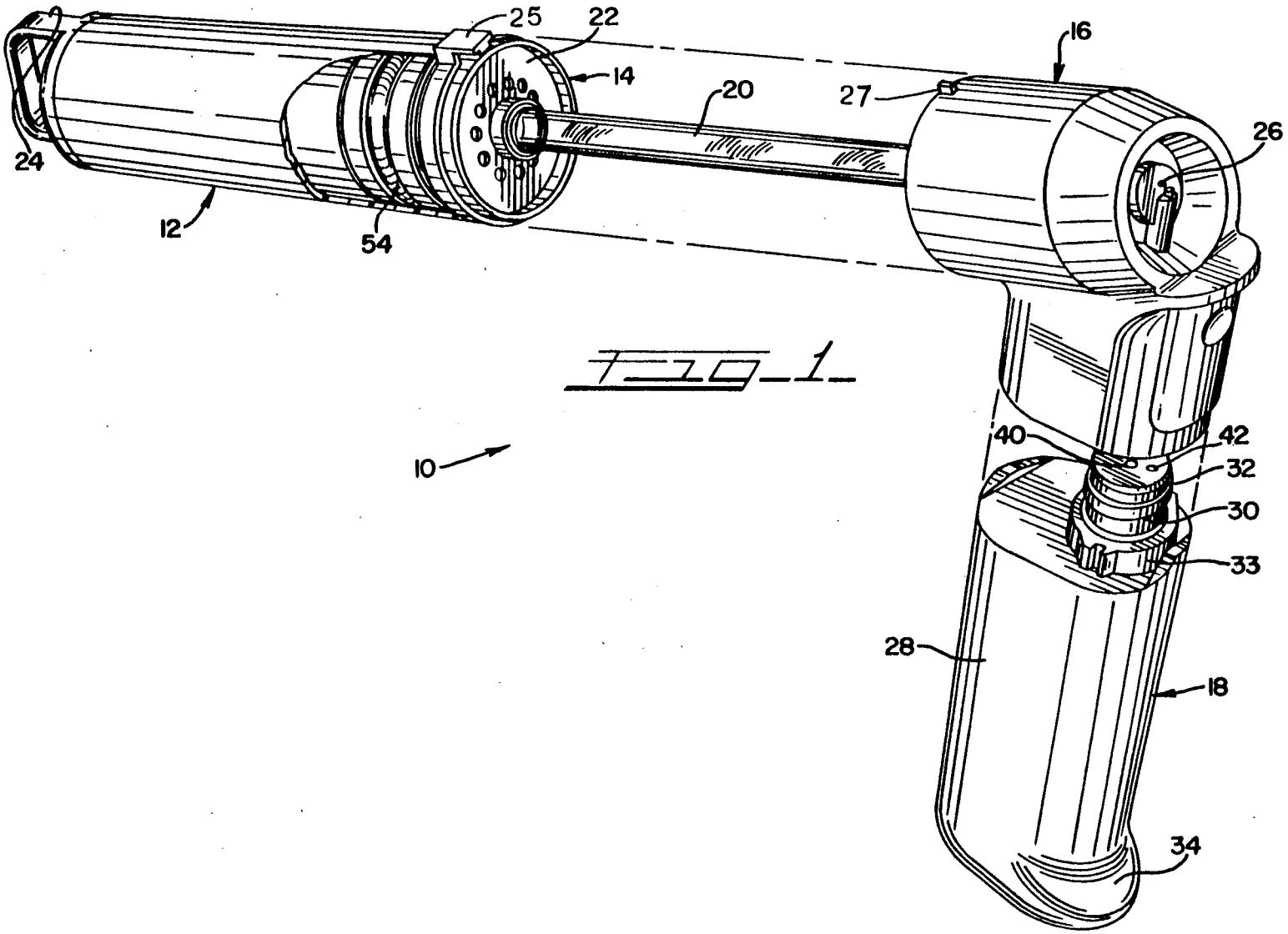
FIG. 1 is a partially exploded perspective view of the fluid spray device.

Throughout the figures, like reference numerals are used to refer to like parts. For clarity, the major components of the fluid spray device are briefly discussed with reference to the drawings of the complete device. The major components are then discussed in more detail with reference to the drawings of the individual components.

FIG. 1 is an exploded and partially sectioned perspective drawing of fluid spray device 10 showing pump cylinder 12, piston 14, spray head 16, and fluid reservoir 18.

Figure 2:
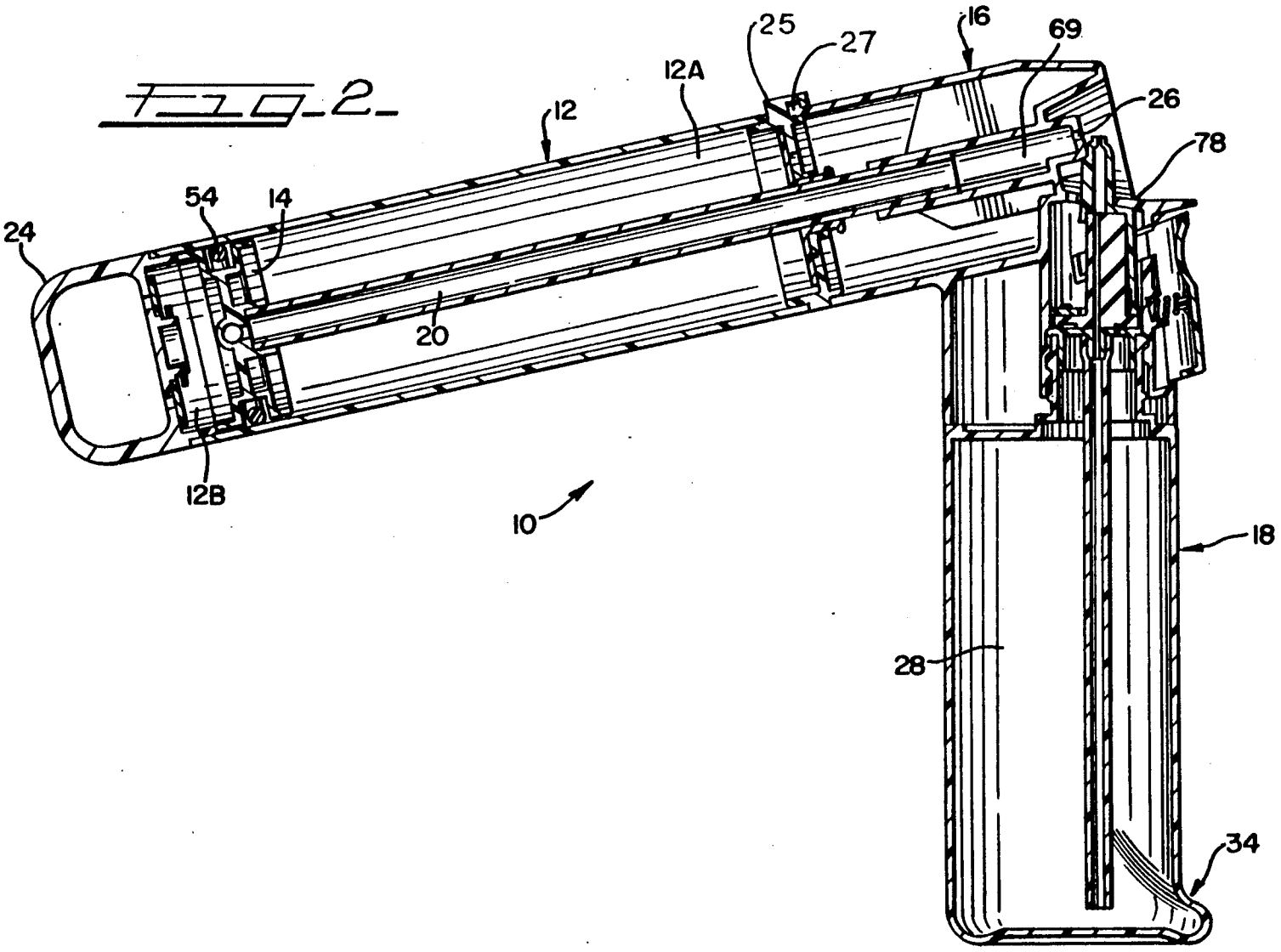
FIG. 2 is a side sectional view of the fluid spray device.

FIG. 2 is a side sectional view of fluid spray device 10 in the compressed position.

As is shown in FIG. 2 (some portions also being visible in FIG. 1) piston 14 of fluid spray device 10 is made up of hollow piston shaft 20 and piston head 22. Pump cylinder 12 is a hollow cylinder, having at one end handle structure 24 and at its other end being designed to be moved into position so as to fit against spray head 16.

Spray head 16 has the overall configuration of two "tubes" conjoined at an approximately 78° angle. One "tube" serves to accept and, hold, by means of internal structure, fluid reservoir 18 and the other "tube" is designed so that piston shaft 20, by means of internal structure, fits therein.

At the other end of the "tube" into which piston shaft 20 fits is air discharge port 26, which is open to and in open communication with piston shaft 20 so as to allow air access therebetween.

Fitted slideably over and around piston head 22 is pump cylinder 12. Pump cylinder 12 is divided into two chambers of variable lengths (designated pump chamber 12A and pump chamber 12B) by piston head 22 and has at each end thereof means for allowing air to enter the chamber. Pump cylinder 12 can be locked into position against spray head 16 by rotatable locking ring 25 which engages locking tab 27 formed on spray head 16. This locking feature is not only a convenience feature, keeping the device compactly together when not in use, but also a safety feature, making it more difficult for a child to activate the device.

Fluid reservoir 18 has reservoir body 28 and reservoir neck 30. Reservoir neck 30 has, upon its outer surface, outer surface neck male screw thread 32 which enables fluid reservoir 18 to be detachably attached to spray head 16. Around reservoir neck 30 of fluid reservoir 18 is reservoir neck stop-mechanism 33, which has the form of a collar with two detent notches therein. Reservoir neck-stop mechanism 33 is designed to mate with two corresponding ribs 35 located within spray head 16. Formed into and projecting outwardly from reservoir body 28 is grip structure 34.

Figure 3:
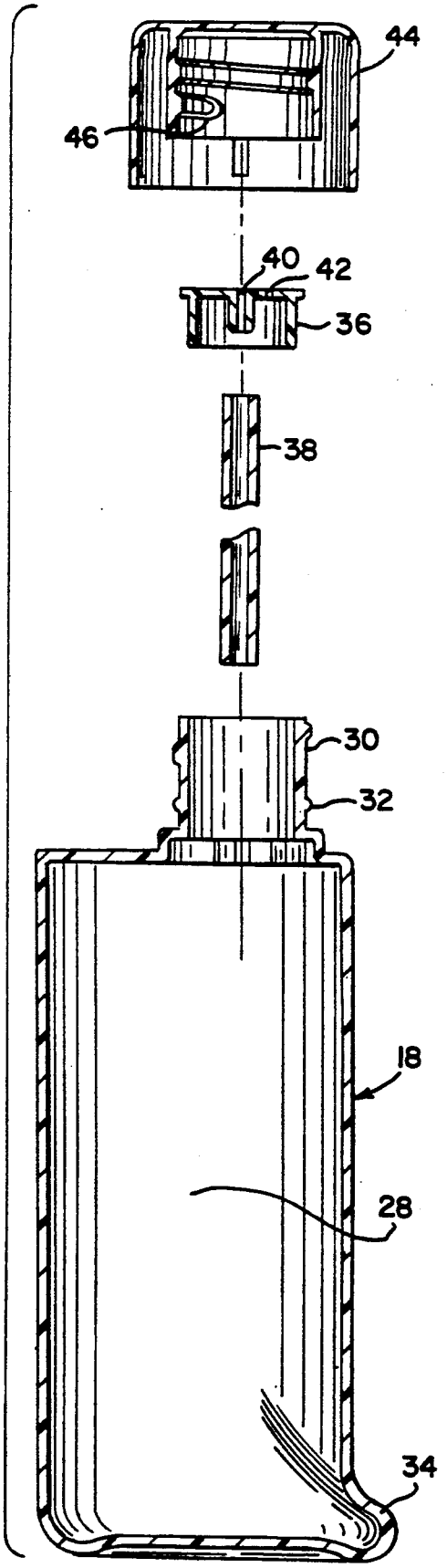
FIG. 3 is an exploded side sectional view of the fluid reservoir and dip tube of the fluid spray device.

FIG. 3 shows an exploded side sectional view of fluid reservoir 18. Extending from neck plug 36 inwardly into reservoir body 28 is dip tube 38. FIG. 1 shows that neck plug 36 has therethrough two holes: fluid transfer hole 40 (seen in FIG. 1), from which dip tube 38 extends and reservoir air vent hole 42 (also visible with FIG. 1), which allows pressure equalization within fluid reservoir 18 as fluid contained therein is pumped from the device.

Cap 44 may be fitted onto outer surface neck male screw thread 32 on reservoir neck 30 which has therein cap female screw thread 46. Cap 44 has within it a cap liner (not visible but located against and inside the top of cap 44) which is designed to seal both fluid transfer hole 40 and reservoir air vent hole 42. This enables fluid reservoir 18, when detached, to be filled, transported, and sold separately from the pumping and spraying components of fluid spray device 10. A fluid reservoir to be used with the device may be made to be disposable after use or refillable.

Figure 4:
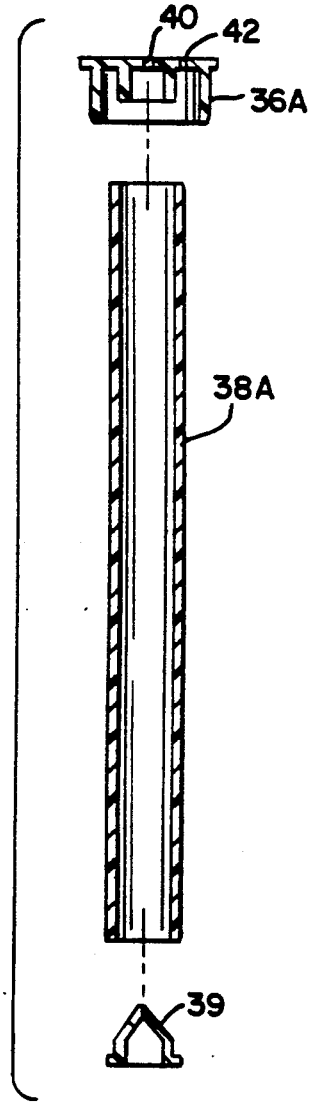
FIG. 4 is an exploded side sectional view of an alternative dip tube assembly with a fluid valve.

FIG. 4 shows an alternative dip tube assembly. Alternative Dip tube 38A has a proportionately wider diameter than does dip tube 38 of the preferred embodiment. This is done to allow insertion of duck bill valve 39, which serves to retain fluid within alternative dip tube 38A after each pumping stroke, thus obviating the need for extra priming pumping actions before the device will emit spray.

Figure 5:
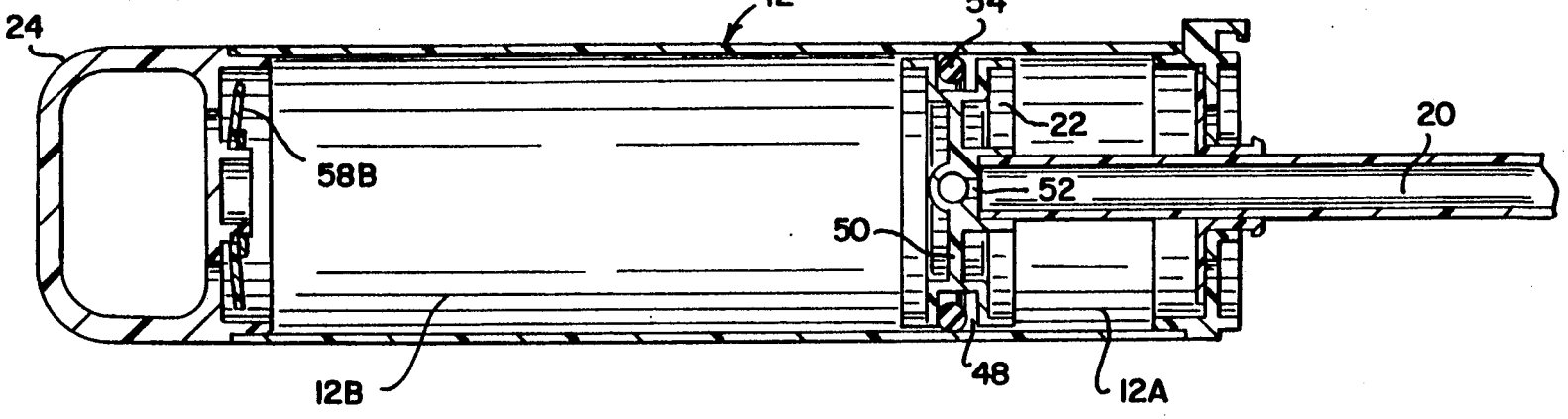
FIG. 5 is a partial side sectional view of the pumping chamber of the fluid sprayer in the extended configuration.
Figure 6:
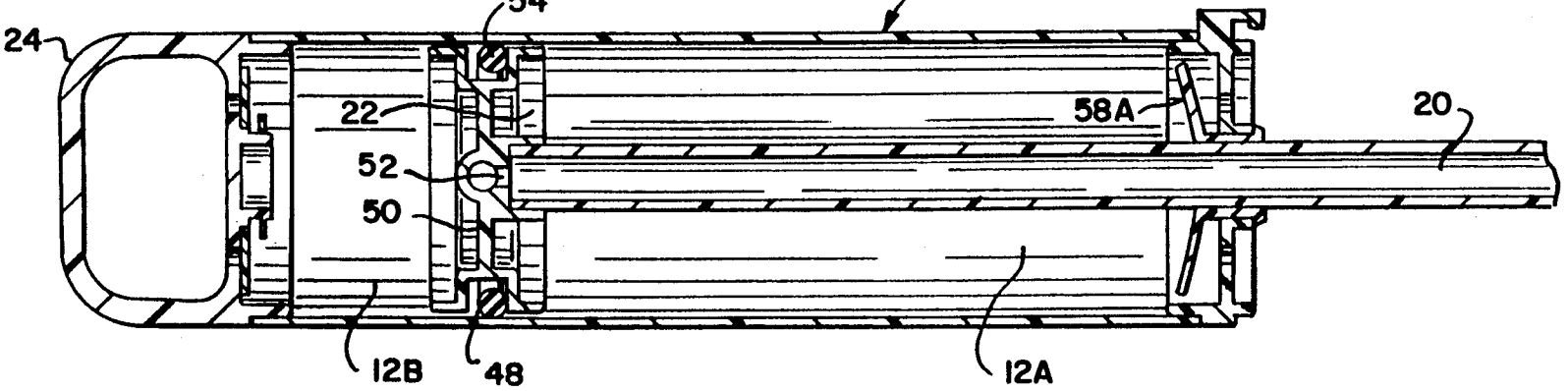
FIG. 6 is a partial side sectional view of the pumping chamber of the fluid sprayer in the compressed position.

FIGS. 5 and 6 show cross-sections of the pumping mechanism of fluid spray device 10.

Figure 9:
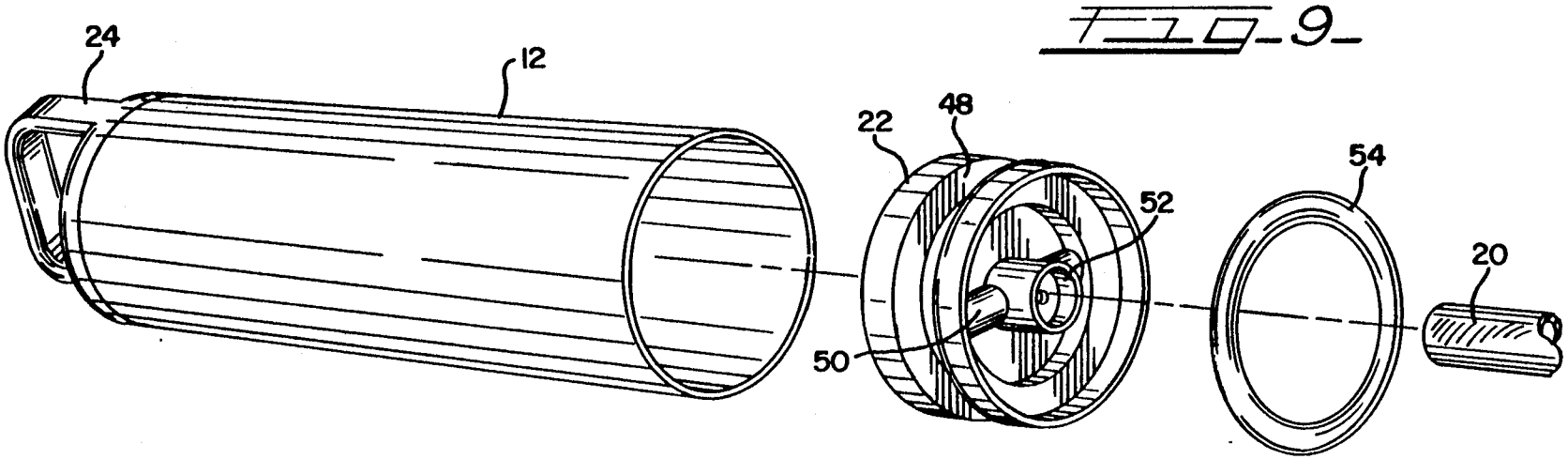
FIG. 9 is a side exploded perspective view of the piston rod and piston head and pump cylinder assembly.

As shown in greater detail in FIG. 9, piston head 22 which has an outer diameter slightly less than the inside diameter of pump cylinder 12, fits slideably within pump cylinder 12, has around its circumference piston head channel 48. Extending through piston head 22 and having openings into piston head channel 48 on opposite sides of piston head 22 is piston head air conduit 50. At right angles to piston head air conduit 50 and opening into piston shaft 20 is piston shaft air access opening 52. Situated moveably within piston head channel 48 is o-ring 54. O-ring 54 has a diameter slightly greater than that of piston head 22, so that when o-ring 54 is in place within piston head channel 48 and the assembled piston is positioned with pump cylinder 12, only the outer surface of o-ring 54 comes into slideable contact with the inner surface of pump cylinder 12.

Figure 7:
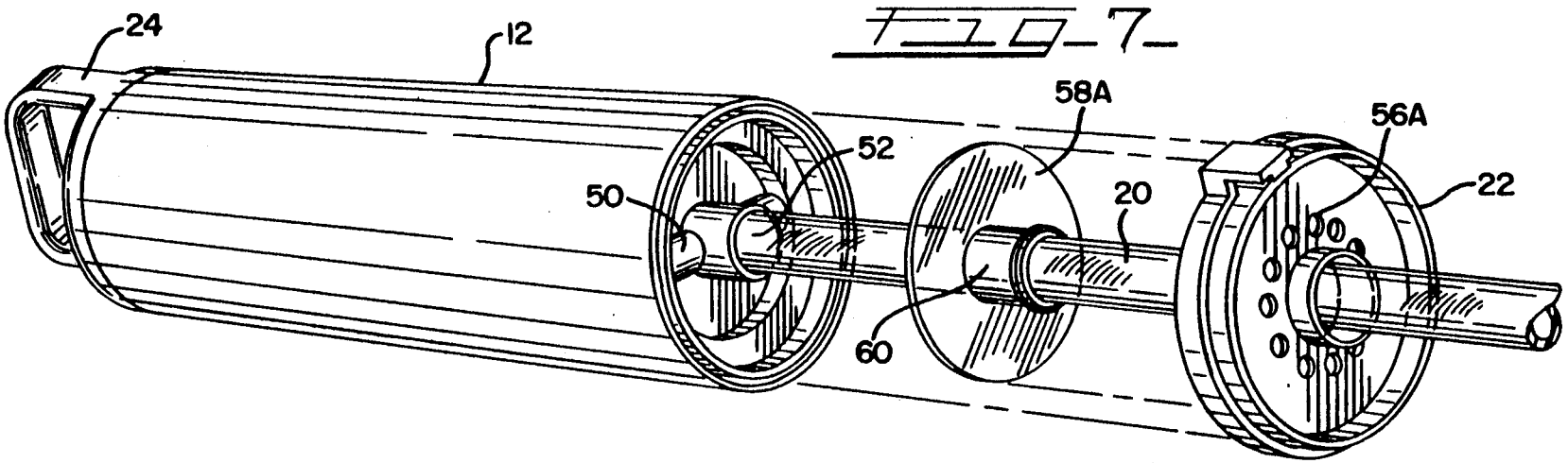
FIG. 7 is an exploded perspective view of one endpiece assembly of the pumping chamber.
Figure 8:
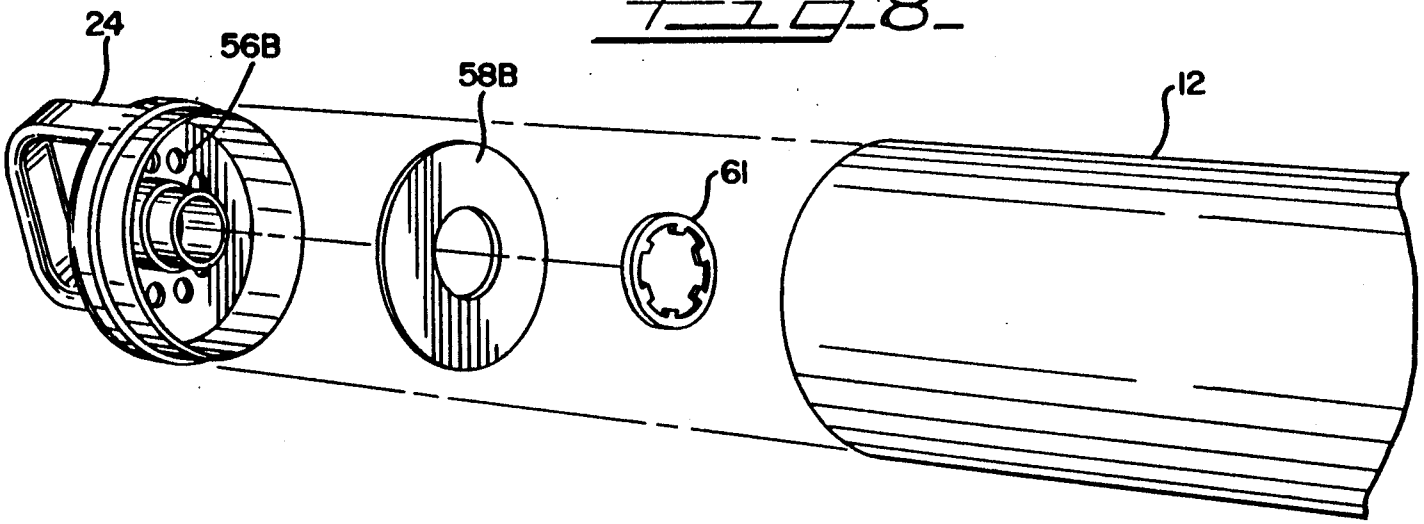
FIG. 8 is an exploded perspective view of a second endpiece assembly of the pumping chamber.

Pump cylinder 12 has at each end thereof closeable means for allowing air to enter the pumping chambers. These are, as shown in FIGS. 7 and 8, a series of pump cylinder air holes 56 (designated pump cylinder air holes 56A and pump cylinder air pump cylinder air holes 56B) at each end closure of pump cylinder 12. On the inside of each of these series of pump cylinder air holes 56, located within pump cylinder 12 is a flapper valve 58 (designated flapper valve 58A and flapper valve 58B). Flapper valve 58A, slideably locatable adjacent handle structure 24, is held in place by retaining collar 60 which is integrally formed with flapper valve 58B. Flapper valve 58B is held into place by a retaining ring 61.

As FIG. 5 shows, when fluid sprayer device 10 is placed in its extended position by a user pulling back on handle structure 24 attached to the end of pump cylinder 12 in the direction away from spray head 16, piston shaft 20, which connects to spray head 16 at one end and to piston head 22 at its other end, is exposed. Piston head 22 is positioned toward the forward end of pump cylinder 12. As piston head 22 is moved toward this position a relative vacuum is created within pump chamber 12B. This relative vacuum pulls on flapper valve 58B, which deforms inwardly, allowing atmospheric air to enter pump chamber 12B through air access pump cylinder air holes 56B. At the same time, air already in pump chamber 12A is compressed and o-ring 54 is pushed, by the relative motion of pump cylinder 12 and piston head 22 toward the back side of piston head channel 48. This position of o-ring 54 exposes that portion of piston head air conduit 50 that lies toward pump chamber 12A. This allows the now pressurized air from pump chamber 12A to first enter piston head air conduit 50, then piston shaft air access opening 52 and thence down piston shaft 20 (and ultimately out air discharge port 26).

As FIG. 6 shows, when pump cylinder 12 is in its compressed position, the operation of the pump is essentially reversed. As a user pushes handle structure 24 in the direction of spray head 16, pump cylinder 12 moves so that piston head 22 is relatively moved to a position toward handle structure 24. Air in pump chamber 12B is compressed by this relative motion and is allowed to escape down piston shaft 20 by the motion of o-ring 54, which is moved within piston head channel 48 toward the front side of piston head channel 48. This opens the portions of piston head air conduit 50 that lies toward pump chamber 12B and allows the now compressed air from pump chamber 12B to enter piston head air conduit 50, then piston shaft air access opening 52 and thence pass down piston shaft 20 (and ultimately out air discharge port 26). At the same time, the relative motion of piston head 22 toward the back of pump cylinder 12 creates a relative vacuum in pump chamber 12A, which pulls on flapper valve 58B, which deforms inwardly, allowing atmospheric air to enter pump chamber 12A through pump cylinder air vent holes 56B.

Figure 11:
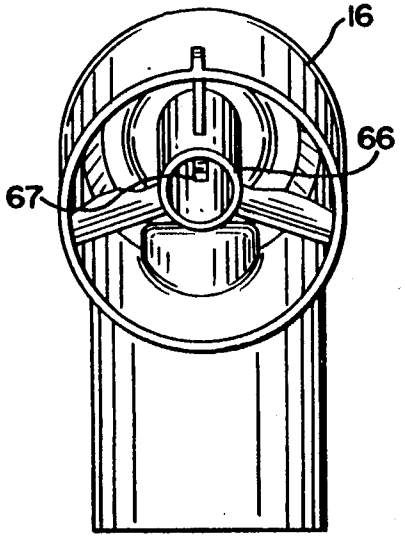
FIG. 11 is a back elevational view of the spray head.
Figure 10:
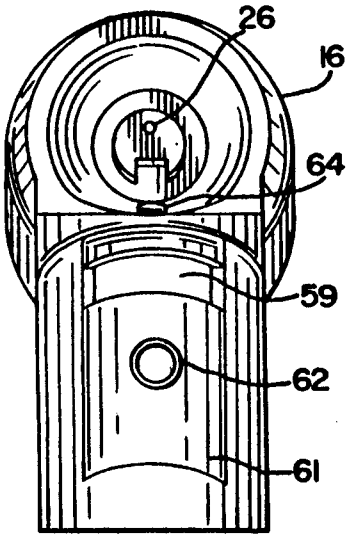
FIG. 10 is a front elevational view of the spray head.

Spray head 16, as shown on FIG. 10 (and FIG. 13), has air discharge port 26, pressure bar access slot 59, actuator seat area 63, spray head 16, spray head spring retainer 62, and carrier tube opening 64. Formed into the back side of spray head 16, shown on FIG. 11, is piston shaft accepting structure 66. Piston shaft accepting structure 66 is D-stop 67, which serves to correctly position piston shaft 20 within piston shaft accepting structure 66. Within piston shaft accepting structure 66 narrows near air discharge port 26 to form venturi passage 69 (visible in FIG. 2).

Figure 12:
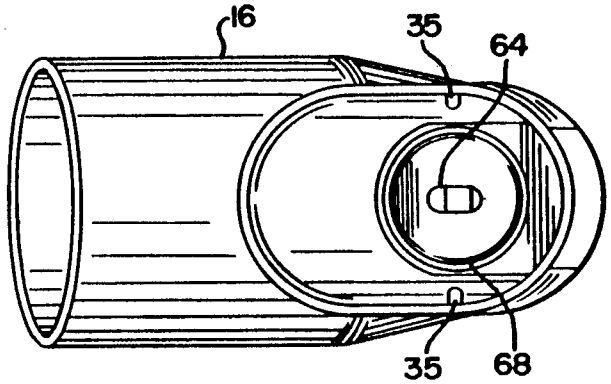
FIG. 12 is a bottom plan view of the spray head.

FIG. 12 shows the bottom of spray head 16, the portion into which fluid reservoir 18 will fit. Fluid reservoir neck accepting structure 68, which has carrier tube opening 64, is located within the housing of spray head 16.

Figures 13, 14:
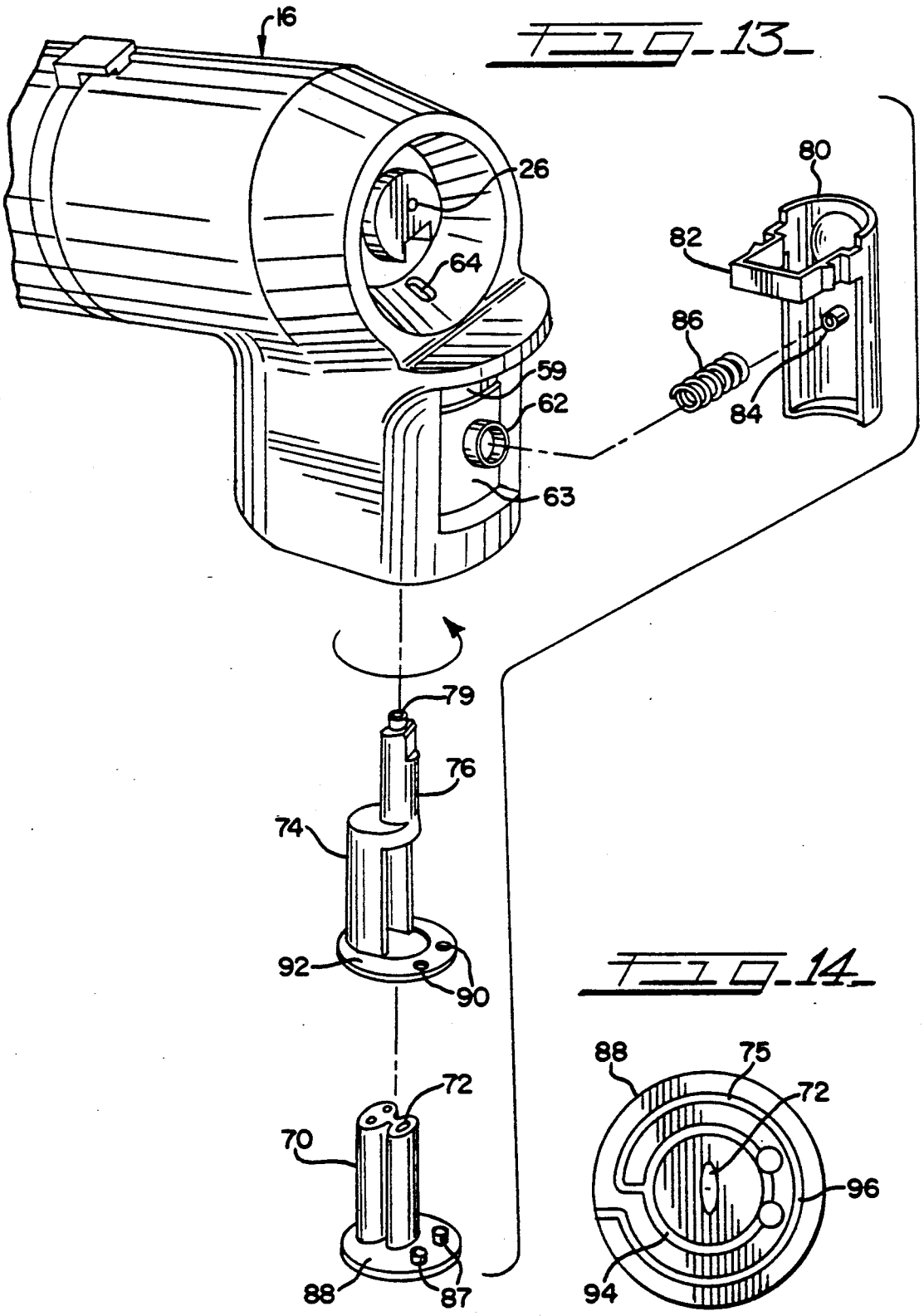
FIG. 13 is an exploded perspective view of the actuator assembly of the fluid spray device.
FIG. 14 is a bottom plan view of the valve member of the actuator assembly.

The actuating mechanism for fluid spray device 10 is shown in FIG. 13. Deformable valve member 70 has formed therethrough valve fluid passageway 72, which is oval in cross-section to provide better flexibility and resilience in use. Deformable valve member 70 fits into valve carrier 74, which has the overall shape of a cylinder partially opened along one side and open at its lower end with tubular structure 76 located on the top thereof in such a way that the portion of deformable valve member 70 that surrounds valve fluid passageway 72 is exposed and is coextensive and in fluid communication with carrier fluid passageway 78 which extends through tubular structure 76. Actuator button assembly 80 has, integrally formed therewith and oriented at approximately a right angle to the body of actuator button assembly 80, pressure bar 82. Pressure bar 82 has on its inner edge pressure lip 83 which serves to localize the pressure extended. Actuator button assembly 80 also has actuator spring retainer 84, designed to fit into spring 86.

The parts fit together and function as follows: Spring 86 is positioned upon actuator spring retainer 84. Actuator button assembly 80 is oriented above actuator seat area 63 of spray head 16. The actuator button assembly 80 is placed against actuator seat area 63. Pressure bar 82 is thus inserted into the interior of spray head 16 through pressure bar access slot 59 and spring 86 fits into spray head spring retainer 62. Deformable valve member 70 is placed within valve carrier 74, where it is held by means of two projections 87 formed onto valve base 88, of deformable valve member 70, which are designed to fit into and stay within two correspondingly sized holes 90 in carrier base 92 of valve carrier 74 when deformable valve member 70 is placed into valve carrier 74. The preassembled valve member and carrier assembly is then inserted into the bottom portion of spray head 16 in such a way that deformable valve member 70 is exposed to pressure bar 82 along that side of deformable valve member 70 through which valve fluid passageway 72 extends. Tubular structure 76 then extends through carrier tube opening 64 in spray head 16. Tubular structure 76 has a fluid discharge orifice 79 located adjacent to and just below air discharge port 26 on spray head 16.

Spring 86 thus biases actuator button assembly 80 away from the housing of spray head 16 and pressure lip 83 of pressure bar 82 is pulled against the exposed portion of deformable valve member 70 containing valve fluid passageway 72. Valve fluid passageway 72 is deformed to a flattened or closed position by this pressure, making "closed" the normal, non-actuated position for fluid spray device 10.

When a user presses on the outside surface of actuator button assembly 80, spring 86 is compressed between the inside surface actuator button assembly 80 and the outside surface of spray head 16. Pressure bar 82 is thus forced out of contact with deformable valve member 70 and valve fluid passageway 72, relieved of this deforming pressure, opens up, allowing fluid to be drawn from attached fluid reservoir to fluid discharge orifice 79 of tubular structure 76.

As described before, neck plug 36 of fluid reservoir 18 has reservoir air vent hole 42.

As shown in FIG. 14, the bottom of the valve base 88 of deformable valve member 70 has formed therein reservoir air access channel 75, which has an inner circular air access channel 94 and a tortuous path air access channel 96 which extends to the outer perimeter of the valve base 88 of deformable valve member 70. This configuration has two purposes. Since neck plug 36 may, in assembly of reservoir neck 30 be placed into different relative orientations within fluid reservoir 18, inner circular air access channel 94 is designed to overlie and be in open communication with reservoir air vent hole 42 in neck plug 36 so as to allow air access therebetween regardless of the relative orientation of neck plug 36 and reservoir neck 30. The configuration of tortuous path air access channel 96 allows atmospheric air to reach the interior of fluid reservoir 18 (and equalize the interior pressure as fluid is pumped from the device) while at the same time presenting fluid leakage should the assembled pump gun (with a fluid-filled reservoir) be placed on its side.

When the entire valve actuator assembly is in position within spray head 16, and fluid reservoir 18 has been fitted into and turned within fluid reservoir neck accepting structure 68 of spray head 16, reservoir air vent hole 42 is positioned above and open to reservoir air access channel 75. This design of reservoir air access channel 75 allows, when fluid reservoir 18 is fitted against the base of deformable valve member 70, reservoir air vent hole 42 to be in open communication with reservoir air access channel so as to allow air access therebetween regardless of the relative orientation of neck plug 36 within fluid reservoir 18. When fluid is drawn out of fluid reservoir 18 by the action of the air projected over the fluid discharge orifice by the relative action of pump cylinder 12 and piston 14, atmospheric air can thus first enter tortuous path air access channel 96 and then enter inner circular air access channel 94 of reservoir air access channel 75, pass into reservoir air vent hole 42, and enter fluid reservoir 18 to equalize the pressure between the atmosphere and interior of fluid reservoir 18 when fluid is pumped from fluid reservoir 18.

Other modifications of the fluid spray device of the present invention will become apparent to those skilled in the art from an examination of the above patent Specification and drawings. Therefore, other variations of the present invention may be made which fall within the scope of the following claims even though such variations were not specifically discussed above.

INDUSTRIAL APPLICABILITY

The present invention can be used for the application of any fluid product. The most probable uses would be for the application of pesticides, liquid fertilizers, and cleansers.

The manufacturing advantages of the invention arise from its simplicity and consequent economy of materials and of manufacturing processes. The use advantages are primarily 1) the fact that such a device needs neither propellant nor power (beyond that supplied by the user), 2) the efficiency of the pumping action and 3) the convenience of the use of a replaceable fluid cartridge.

What is claimed is:

1. A fluid spray device utilizing a double-action pump comprising:

a piston, a pump cylinder, a spray head structure, a fluid reservoir, and a fluid transfer system, the piston having a hollow piston shaft having first and second ends, with the first end of the hollow piston shaft fitting into a piston head and the second end of the hollow piston shaft fitting and opening into a spray head channel within the spray head structure, the pump cylinder being a hollow cylinder, having inner and outer surfaces, within which the piston head and the hollow piston shaft attached thereto are relatively moveable in such a way that the pump cylinder is divided, by the piston head, into a first and a second pumping chamber of relatively variable lengths, the pump cylinder further having, at one end thereof, means for admitting ambient air into the first pumping chamber and, at a second end thereof, means for admitting ambient air into the second pumping chamber, the spray head structure having an air discharge port in fluid communication with the spray head channel and having a fluid discharge opening which receives a tube structure having a discharge orifice which is in fluid communication with the fluid reservoir and the spray head structure also having a reservoir connection area, the fluid reservoir having a reservoir neck portion and a body portion, the reservoir connection area and the reservoir neck portion being so configured that the reservoir neck portion removably connects to the reservoir connection area, of the spray head structure, the fluid transfer system comprising the tube structure, and valving means for controlling the flow of fluid from the fluid reservoir to the fluid discharge orifice, from whence the fluid will, by the action of air forced from the pump cylinder on either stroke through the piston shaft and out the air discharge port of the spray head structure, be aspirated up from the body portion of the fluid reservoir to the fluid discharge orifice and then sprayed from the fluid spray device.

2. The fluid sprayer of claim 1 further comprising means for admitting air into the piston shaft comprising an o-ring which fits within a channel around the circumference of the piston head, the channel having a bottom and first and second channel sides, and a piston head transverse passage, passing through the center of the piston head and having openings at each end into the circumferential channel of the piston head, the piston head transverse passage being intersected by and openings into a central piston head receptor structure, which receives and is open to the first end of the hollow piston shaft, to allow air access therebetween, the o-ring being moveable by the relative motion of the pump cylinder between a first position, in which it rests against the first side of the channel, and a second position in which it rests against the second side of the channel, each of said positions of the o-ring exposing the openings of the piston head transverse passage to the opposite side of the channel from that against which the o-ring rests.

3. The fluid sprayer of claim 2 wherein the piston head has an outer diameter smaller than the inner diameter of the pump cylinder and smaller than the outer diameter of the o-ring so that, when the piston head is moved relative to the pump cylinder, the o-ring slideably and sealingly contacts the inner surface of the pump cylinder and is moved within the channel of the piston head by that slideable contact.

4. The fluid sprayer device of claim 1 wherein the means for admitting air into the first and second pumping chambers comprises a plurality of holes through each of said ends of the pump cylinder and, located at each end of the pump cylinder, a flapper valve, sized to cover the holes at the corresponding end of the pump cylinder, each of said flapper valves being attached at its midpoint to the corresponding inside end of the pump cylinder.

5. The fluid sprayer device of claim 1 wherein said valving means for controlling the flow comprises a deformable valve member having a valve top end and a valve base portion and having a fluid passageway therethrough, a carrier for the deformable valve member, the carrier having a top and a bottom end and having located at its top end said tube structure which, when the valve member is placed within the carrier, becomes coextensive with the fluid passageway of the valve member, the tube structure ending in the fluid discharge orifice, a biasing means, and an actuator button having attached thereto a pressure bar designed to interact with the valve member, the actuator button being located on and biased against the outside of the spray head, structure while the deformable member and carrier are located with the spray head structure and the pressure bar of the actuator button extends through an opening through the body of the spray head structure and rests against the deformable valve member in such a way that the fluid passageway of the deformable valve member is closed off by the pressure of the pressure bar unless the actuator button is depressed and the pressure bar pressed away from the deformable member thus allowing the fluid passageway to open.

6. The fluid sprayer device of claim 1 wherein the fluid transfer system comprises a dip tube extending from a neck plug within the neck portion of the fluid reservoir and into the body portion of the fluid reservoir, said valving means for controlling the flow comprising a fluid passageway that extends through the spray head, and the tube structure ending in the fluid discharge orifice, the dip tube, the fluid passageway and the tube structure all being in fluid communication with each other.

7. The fluid sprayer device of claim 5 wherein the fluid passageway of the deformable valve member has an oval shaped cross section.

8. The fluid sprayer device of claim 5 wherein the deformable valve member has an air inlet channel in the valve base portion, the channel having an inner circular channel portion designed to overlie and be in open communication with an air vent opening of a neck plug of the fluid reservoir so as to allow air access therebetween regardless of the orientation of the neck plug and having a tortuous path channel portion leading from the inner circular portion to the periphery of the valve base portion of the deformable valve member, designed to allow air to reach the interior of the fluid reservoir.

9. The fluid sprayer device of claim 8 wherein the fluid reservoir has a dip tube extending from the neck plug of the fluid reservoir and into the body of the fluid reservoir, and the neck plug of the fluid reservoir has the air vent opening at the top thereof.

10. The fluid sprayer device of claim 1 wherein the pump cylinder has, at one end thereof, a handle structure.

11. The fluid sprayer device of claim 1 wherein the pump cylinder and the spray head structure have cooperative means for detachably locking the pump cylinder into position against the spray head structure.

12. The fluid sprayer device of claim 1 wherein the fluid reservoir has, surrounding the neck portion thereof, a stop-mechanism structure which is designed to mate with a corresponding stop-mechanism structure formed within the body of the spray head structure, the cooperating stop-mechanism structures being designed to correctly orient the fluid reservoir into position within the spray head structure.

* * * * *

UNITED STATES PATENT AND TRADEMARK OFFICE

CERTIFICATE OF CORRECTION

PATENT NO. : 5,102,052

DATED : April 7, 1992

INVENTOR(S) : Scott W. Demarest; James E. Buhler; and Allen D. Miller

It is certified that error appears in the above-identified patent and that said Letters Patent is hereby corrected as shown below:

In Claim 2, column 8, line 2, please delete "openings" and insert -- opening -- in place thereof.

In Claim 5, column 8, lines 43-44, please delete "head, structure" and insert -- head structure, -- in place thereof.

In Claim 5, column 8, line 45, please delete "with" and isnert --within-- in place thereof.

Signed and Sealed this

Twentieth Day of July, 1993

*Attest:*

Michael K. Kirk

MICHAEL K. KIRK

*Attesting Officer*

*Acting Commissioner of Patents and Trademarks*